US010214898B2

(12) United States Patent
Mohorn

(10) Patent No.: US 10,214,898 B2
(45) Date of Patent: Feb. 26, 2019

(54) DEVICE FOR INTENSIFYING OR REVERSING A GEO-GRAVOMAGNETIC FIELD

(71) Applicants: Wilhelm Mohorn, Reichenau an der Rax (AT); Caroline Mohorn, Vienna (AT)

(72) Inventor: Wilhelm Mohorn, Reichenau an der Rax (AT)

( * ) Notice: Subject to any disclaimer, the term of this patent is extended or adjusted under 35 U.S.C. 154(b) by 0 days.

(21) Appl. No.: 15/566,782

(22) PCT Filed: Apr. 15, 2016

(86) PCT No.: PCT/EP2016/058317
§ 371 (c)(1),
(2) Date: Oct. 16, 2017

(87) PCT Pub. No.: WO2016/166267
PCT Pub. Date: Oct. 20, 2016

(65) Prior Publication Data

US 2018/0112393 A1 Apr. 26, 2018

(30) Foreign Application Priority Data

Apr. 17, 2015 (AT) ..... A 50304/2015

(51) Int. Cl.
*E04B 1/00* (2006.01)
*H01F 27/28* (2006.01)
(Continued)

(52) U.S. Cl.
CPC ..... *E04B 1/7007* (2013.01); *H01F 5/003* (2013.01); *H01F 27/02* (2013.01); *H01F 27/2804* (2013.01); *H01F 2005/006* (2013.01)

(58) Field of Classification Search
CPC ..... H01F 27/2804; H01F 17/0006; H01F 2017/0073; A61N 1/16; A61N 2/02; E04B 1/7007
See application file for complete search history.

(56) References Cited

U.S. PATENT DOCUMENTS 4,418,481 A * 12/1983 Wehrli ..... E04B 1/7007 34/250
4,494,100 A * 1/1985 Stengel ..... H01F 5/003 336/200
4,635,378 A * 1/1987 Wehrli ..... E04B 1/7007 34/250
2004/0000974 A1* 1/2004 Odenaal ..... H01F 17/0006 333/219
2016/0035477 A1* 2/2016 Yeh ..... H01F 27/2804 320/108

FOREIGN PATENT DOCUMENTS

AT 382915 B * 4/1987 ..... E04B 1/70
DE 102004015235 A1 * 6/2005 ..... E04B 1/70
(Continued)

OTHER PUBLICATIONS

WO 9420702 A2, Sep. 1994, Machiine Translation.*
(Continued)

*Primary Examiner* — Elvin G Enad
*Assistant Examiner* — Malcolm Barnes
(74) *Attorney, Agent, or Firm* — David Guerra

(57) ABSTRACT

The invention relates to a device for intensifying or reversing a geo-gravomagnetic field having a certain frequency in order to add moisture to or remove moisture from moist capillary-capable masonry or such floors, to transport dissolved salts in the capillary water or to colloidally plug the capillaries after the drying out, and to reduce or suppress and to intensify a gravomagnetic disturbance field of a certain frequency by means of at least one electrical conductor, which is arranged in a housing (6) and is wound into a spiral
(Continued)

or conically spiral coil (100, 101, 102, 103, 101*a*, 102*a*, 103*a*), wherein the winding diameter of the coil becomes smaller from the outer end to the center of the coil in the manner of a spiral, wherein the largest coil radius (R1) between the outer end of the coil and the coil axis is an integer multiple of half of a grid line width having a permissible deviation of one eighth of a grid line width of the grid network of the gravomagnetic field.

16 Claims, 2 Drawing Sheets

(51) Int. Cl.

| | |
|---|---|
| ***H01F 17/00*** | (2006.01) |
| ***E04B 1/70*** | (2006.01) |
| ***H01F 27/02*** | (2006.01) |
| ***H01F 5/00*** | (2006.01) |

(56) References Cited

FOREIGN PATENT DOCUMENTS

| | | | | |
|---|---|---|---|---|
| EP | 152510 | A1 | 8/1985 | |
| EP | 0688383 | A1 | 12/1995 | |
| EP | 1791137 | A1 | 5/2007 | |
| WO | WO 9420702 | A2 * | 9/1994 | ..... E04B 1/70 |

OTHER PUBLICATIONS

DE 102004015235 A1, Jun. 2005, Machine Translation.*
AT 382915 B, Apr. 1987, Machine Translation.*
Forschungskreis Erdstrahlen Und Elektrosmog E V, Globalgittemetz, Currygittemetz, Hartmanngitter, Gesteinsbruch, Gesteinsverwerfung, Krebspunkt, https://web.archive.org/web/20120721212856/http://www.erdstrahlen-elektrosmog.de/Currygitternetz-+-globalgitternetz.html.

* cited by examiner

DEVICE FOR INTENSIFYING OR REVERSING A GEO-GRAVOMAGNETIC FIELD

CROSS-REFERENCE TO RELATED APPLICATIONS

This application is an U.S. national phase application under 35 U.S.C. § 371 based upon co-pending International Application No. PCT/EP2016/058317 filed on Apr. 15, 2016. Additionally, this U.S. national phase application claims the benefit of priority of co-pending International Application No. PCT/EP2016/058317 filed on Apr. 15, 2016 and Austria Application No. A50304/2015 filed on Apr. 17, 2015. The entire disclosures of the prior applications are incorporated herein by reference. The international application was published on Oct. 20, 2016 under Publication No. WO 2016/166267 A1.

BACKGROUND OF THE INVENTION

Field of the Invention

The invention relates to a device for intensifying or reversing a geo-gravomagnetic field having a certain frequency in order to add moisture to or remove moisture from moist capillary-bearing masonry or such floors, to transport dissolved salts in the capillary water or to colloidally plug the capillaries after the drying out and to reduce or suppress and to intensify a gravomagnetic disturbance field of a certain frequency by means of at least one electrical conductor, which is arranged in a housing and is wound into a spiral or conical spiral coil, wherein the winding diameter of the coil decreases from the outer end to the centre of the coil in the manner of a spiral.

DESCRIPTION OF THE PRIOR ART

Devices have already been known for a long time, which, without being in direct contact with materials to which moisture is to be added or from which moisture is to be removed, exert a moisture-adding or moisture-removing effect. The action of these devices resides in the fact that the adhesive forces between moisture molecules and [solid] substance molecules are disturbed by certain electromagnetic fields of a certain frequency in the high frequency microwave region in porous, capillary-like material systems, such as building materials or soil. This results in lowering the capillary moisture level. Devices exhibiting resonance frequencies in the lower frequency range, e.g. through external excitation by corresponding existing short waves in the short wave range, can cause exactly the opposite, in that they provoke an increase of the wall potential, e.g. by the diode effect of the wall, thereby causing an increase in the wall moisture.

Then there are also passive electromagnetic devices—including resonant circuit based—which have no direct connection to a power source and which operate exclusively with energies present in the environment, entering into resonance therewith. Many of these devices are more or less capable of resonating in at least two resonance spectra, namely the mechanical spectrum, and the electromagnetic spectrum. The effect of these devices is usually very weak and, more importantly, the capacitors are destroyed over and again or, at least, are damaged by electrostatic discharges, such as lightning flashes.

Very advanced and innovative devices utilise an only recently discovered spectrum, namely the geo-gravomagnetic spectrum of the Earth.

A gravomagnetic wave, as far as can be demonstrated, consists of a circularly polarised magnetic wave component and a gravitational wave component rotating about the magnetic wave in a circularly polarised manner. One whole wave oscillation of the magnetic component represents usually a plurality of wave oscillations of the gravitational component, as far as wave structure research showed.

In the device described in EP 688 383 B1, the spacing between the windings of a spiral or conical spiral coil and the coil axis inwards is smaller by 40% to 60% with each full rotation than the previous spacing. Numerous tests have shown that a device equipped in this fashion is far better suited to meet the requirements of adding moisture and removing moisture than one of the previously known devices in which the spirally-wound coil exhibited constant winding spacings, wherein, moreover, a fault-prone capacitor had to be switched between the ends of the coil.

In tests using the device according to EP 688 383 B1 it has been found that the device also has an effect on gravomagnetic intensity abnormalities and polarisation anomalies (geological interference fields) and is able to attenuate the latter.

In addition to the Earth's magnetic field, the gravitational field, the electrostatic field, the electromagnetic radiation etc., different gravomagnetic field structures also prevail at any location on the Earth's surface, affecting human and animal beings present there, as well as plants. The strength of each gravomagnetic field also varies. In particular, there are field structures in which the effect is higher and which cover the Earth's surface in a grid-shape. The best known of these so-called grids, according to our research, are of a gravomagnetic nature, even if their origin is still largely unexplored. They are referred to as Hartmann grid—or global grid, Curry grid—or diagonal grid, and the Benker grid. Depending on the type of the grid, but also depending on the conditions at the site and on the geographical area, the grid lines or mesh widths have a width of between 10 and 100 cm (Hartmann grid—10 to 30 cm, Curry grid—20 to 80 cm, Benker grid 60 to 100 cm). At the crossing points of the grid lines of a grid or different grids, their effect is particularly high. They represent geopathogenic zones, i.e. zones which have a negative biological effect on living beings, notably humans, and, at worst, are detrimental to health. In addition, water veins running underground may increase the effect of such crossing points, as they additionally cause enormous gravomagnetic intensity anomalies and/or polarisation anomalies.

BRIEF SUMMARY OF THE INVENTION

It is the object of the present invention, to improve this effect of the device known from EP 688 383 B1 on gravomagnetic fields of different frequencies.

The object was attained by a device with at least one electrical conductor, arranged in a housing and wound into a spiral or conical spiral coil, wherein the winding diameter of the coil decreases from the outer end to the centre of the coil in the manner of a spiral, characterised in that the largest coil radius between the outer end of the coil and the coil axis is a whole number multiple of half of a grid line width having a permissible deviation of one eighth of a grid line width of the grid of the gravomagnetic field. The device polarises, suppresses or attenuates at least the radiation of the gravomagnetic field or amplifies it in a reverse structural design, thereby reducing or reinforcing the geopathogenic effect thereof. In this context, the implementation of the geometry according to the invention results in a substantial attenuation, even up to the cancellation of the gravomagnetic field, and in a strong reduction of the geopathogenic effects thereof. It has also been found that the moisture-adding and moisture-removing effect of the device can further be enhanced by this geometry.

It was also sometimes observed that, after drying out a wall, for example,—the wall, despite the removal of the device, remained dry for a long time, which is unambiguously due to blockage of the capillaries—which can only be done by colloids, as sometimes also happens in an analogous manner in electro-osmotic installations.

It must also be mentioned at this point that tests have shown that a further source of energy enters into the device from above, which is commonly known as a zero-point energy, vacuum field energy, space energy, etc. It is this additional energy which enhances the effect of the devices—which include antennas—which also obviously enter into resonance with this energy flowing in from above.

In order to mitigate the effects of the grid lines and the crossing points of the Hartmann grid, the largest coil radius, according to the invention, is a whole number multiple of half of a grid line width with a permissible deviation of one eighth of a grid line width of the Hartmann grid.

In order to mitigate the effects of the grid lines and the crossing points of the Curry grid, the largest coil radius, according to the invention, is a whole number multiple of half of a grid line width with a permissible deviation of one eighth of a grid line width of the Curry grid.

The more grids are considered and the more individually the grid line widths of the location of the device are taken into account, the better the effect. However, even if using an average grid line width for a particular geographical region, such as a 21 cm grid line width for the Hartmann grid or 32 cm for the Curry grid in Central Europe, remarkable effects are attained in the mitigation of the corresponding gravomagnetic interference fields.

According to a preferred embodiment, the spacing between the windings of the spiral or conical spiral coil and the coil axis inwards is smaller by 40% to 60% with each full rotation than the previous spacing. This geometry known from EP 688 383 B1, in combination with the dimensions according to the invention for the largest coil diameter, has proven particularly effective.

At least one of the coils may be applied as a conductor track on one side of an insulating panel. A further increase of the effect is attained, if the panel has no conductor track in a region around the coil axis, in which case this region has a diameter of at least 3 mm, preferably at least 5 mm, most preferably at least 8 mm.

In this context, the insulating panel on its opposite side preferably carries at least one counter-wound coil, which extends to the common coil axis.

In one embodiment, the coils of the two sides of the panels are short-circuited. Preferably, the coils are short-circuited at their centre. Thus, the gravomagnetic field with the coil-specific frequency is converted at least partially into thermal energy, as happens in a short-circuit loop in the electromagnetic spectrum.

In another embodiment, at a distance above the insulating panel, at least one further coil is retained, which is electrically conductively connected via a connecting conductor to the coil or coils, extending to the coil axis.

In this context, preferably the at least one further coil is a spiral coil or a cylindrical coil and all the coils have the same largest coil radius.

It has proven to be especially advantageous if the diameter of the conductor track-free region is 2 to 4 times, preferably 2.5 to 3.5 times, in particular, three times the thickness of the connecting conductor.

According to a modified embodiment, the insulating panel may have a recess in the conductor track-free region.

Further, it is advantageous, if the spacing between the at least one further coil and the panel is an odd whole number multiple ±10% of the largest coil half radius.

Preferably, the conductor track has a width, which corresponds to 0.007 to 0.018 times, preferably 0.015 times the largest coil radius.

Ideally, the thickness of the connecting conductor corresponds to 0.01 to 0.05 times, preferably 0.04 times the largest coil radius.

BRIEF DESCRIPTION OF THE DRAWINGS

The invention will now be described with reference to the accompanying drawings. In this context.

DETAILED DESCRIPTION OF THE INVENTION

Figure 1:
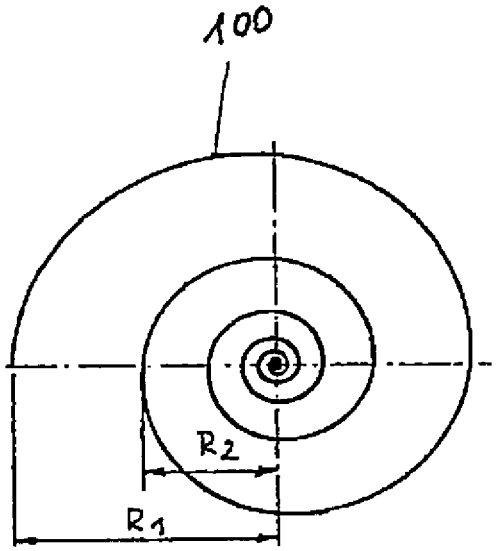
FIG. 1 shows a simple spiral coil, as used in the device according to the invention.

The conductor shown in FIG. 1, formed as a spiral coil 100, includes windings, the mutual spacing of which steadily decreases from the outside towards the inside. As is apparent from the drawing, the largest coil radius R1 from the outer end of the coil to the coil axis is twice as large as the coil radius R2 after a full winding. R2 is thus in a preferred range of 40 to 60% of the radius of the outer adjacent winding. Depending on the prevailing gravomagnetic field to be enhanced or counteracted, the largest coil radius according to the invention is an odd whole number multiple of half of a grid line width of this gravomagnetic field. In this context, one eighth of a grid line width of the grid of the gravomagnetic field is a permissible deviation. The coil according to the invention receives the Earth's gravomagnetic fields and zero-point energy, which is converted into gravomagnetic energy, polarising it. The polarity of the output field is either left- or right polarised, depending on the coil design. When used for adding moisture to or removing moisture from walls or floors a potential, for example in brickwork, can thus be generated, due to which water molecules migrate downwards (in the case of right polarisation) or upwards (in the case of left polarisation).

Figure 2:
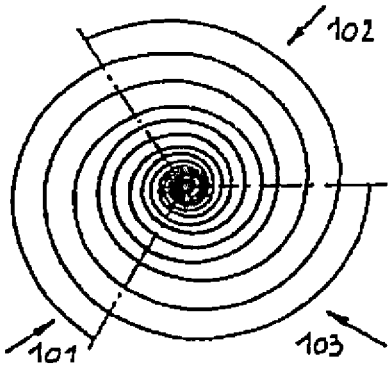
FIG. 2 shows an alternative coil arrangement for a device according to the invention.

FIG. 2 shows a coil combination of three identical spiral coils 101, 102, 103, each offset by 120°, sharing the same coil axis, and wherein the conductors of the spiral coils are interconnected at the location of the coil axis. Instead of three coils, such coil combination may also include only two or more than three coils.

Figure 3:
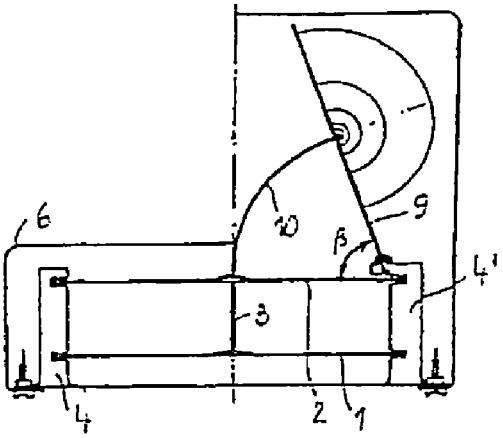
FIG. 3 shows schematically in a longitudinal section the structure of two embodiments of a device according to the invention.

The device according to the invention shown in FIG. 3 includes two panels 1, 2 supporting coils, which are retained in mutually spaced-apart relationship in a housing 6 by brackets 4, 4'. The coils are in this context printed as conductor tracks on the panels 1, 2. The conductor tracks preferably have a width which corresponds to 0.007 to 0.013 times, in particular, 0.01 times the largest coil radius.

Figure 4:
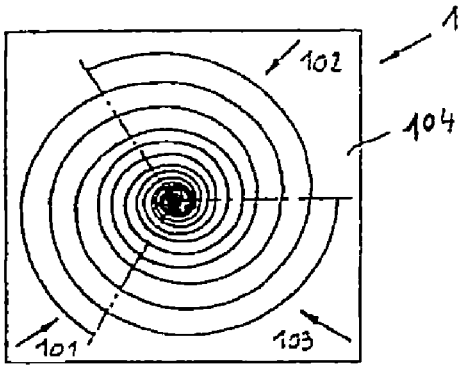
FIG. 4 shows a top view of a panel supporting a coil from the device according to FIG. 3.
Figure 5:
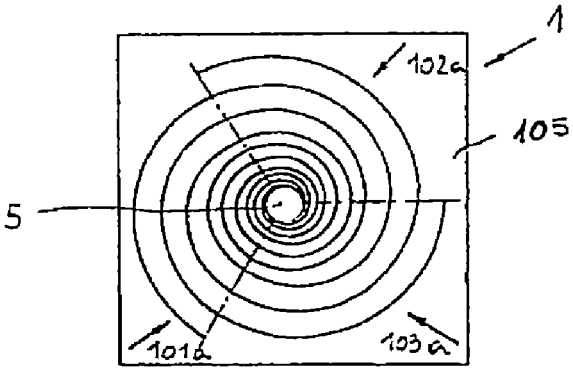
FIG. 5 shows a bottom view of the panel according to FIG. 4.

The bottom panel 1 serves as a receiver which receives the gravomagnetic field. On its upper side 104, it supports, for example, a multi-coil, composed of three coils 101, 102, 103, as shown in FIG. 4. At the bottom 105, isolated from the multi-coil on the upper side 104, it supports a counter-wound multi-coil composed of three coils 101*a*, 102*a*, 103*a*, which has the appearance as shown in FIG. 5. The inner ends of the coils 101*a*, 102*a*, 103*a* of the multi-coil do in this case not extend to the coil axis, so that a central conductor track-free region 5 is provided, which enhances the effect of the device. In a preferred embodiment, this region 5 may have a diameter of at least 3 mm, preferably at least 5 mm and particularly preferably at least 8 mm. In addition, (not shown here) a recess may be provided in the conductor track-free region 5.

The panel 2 arranged in spaced-apart relationship above the panel 1 serving as a receiver, represents a polariser and polarises the energy of the gravomagnetic field absorbed by the receiver. The panel 2 likewise supports a multi-coil, e.g. having the appearance according to FIG. 2. In the example shown, the multi-coil of the upper panel 2 has the same diameter as the multi-coils of the bottom panel 1. The multi-coil of the upper panel 2 is electrically connected to the multi-coil on the upper side 104 of the bottom panel 1 via a connecting conductor 3, the thickness of which corresponds preferably to 0.02 to 0.4 times, in particular 0.03 times, the dimension of the largest coil radius. Good performance of the device has been shown, if the diameter of the conductor track-free region is 2 to 4 times, preferably 2.5 to 3.5 times, in particular, three times the thickness of the connecting conductor.

The two panels 1, 2 are preferably arranged parallel to one another and exhibit a spacing which corresponds to an odd whole number multiple ±10% of the largest coil half radius.

As an alternative, instead of or in addition to the upper panel 2 with a multi-coil, a plurality of panels with single coils may be provided, which also need not be aligned parallel to the bottom panel 1, but may instead be oriented e.g. in different spatial directions in order to ensure the discharge of the field with a better depth effect. This alternative is indicated on the right half of FIG. 3 by panel 9. The coil provided thereon is connected via the connecting conductor 10 to the coil of the upper panel 2 and the coil on the upper side 104 of the bottom panel 1.

Figure 6:
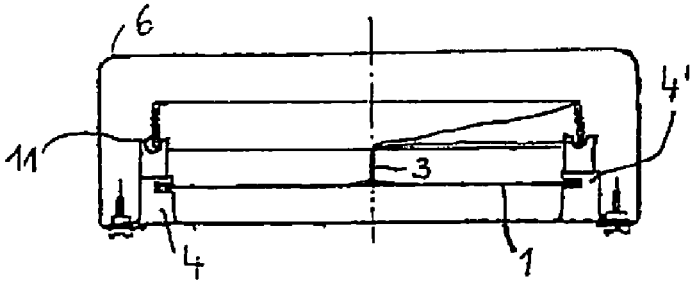
FIG. 6 shows a further embodiment of a device according to the invention.

In a further alternative of the device, instead of the coil printed onto the upper panel, a cylindrical coil 11, which is connected by its two ends to the connecting conductor 3, may be provided in spaced-apart relationship to the bottom panel 1. The cylindrical coil 11 is conductively connected to the coil on the upper side of panel 1 via the connecting conductor 3. The cylindrical coil 11 is retained in spaced-apart relationship to panel 1 by a bracket 8. FIG. 6 schematically represents this embodiment.

Furthermore, in a modified version of the afore-described device, deflection coils 1 may be arranged above the panel 1 in addition to the cylindrical coil 11, in accordance with the embodiment of FIGS. 6 and 7 according to EP 0 688 383 B1. The deflection coils are then likewise connected to the connecting conductor 3 via a coaxial conductor.

In a further embodiment of the device according to the invention, the latter includes a panel, which has printed coils on both sides; the coils may, e.g., look like those in FIG. 2. In this variant, the coils on both sides of the panel are short-circuited, so that the energy received is converted into thermal energy.

The invention claimed is:

1. A device for intensifying or reversing a geo-gravomagnetic field having a certain frequency in order to add moisture to or remove moisture from moist capillary-bearing masonry or such floors, to transport dissolved salts in the capillary water or to colloidally plug the capillaries after the drying out, and to reduce or suppress and to intensify a gravomagnetic disturbance field of a certain frequency, said device comprising:

at least one electrical conductor is arranged in a housing, said conductor being wound into a spiral or conical spiral coil having a winding diameter, said winding diameter of said coil decreases from an outer end to a center of said coil in a manner of a spiral, wherein a largest coil radius (R1) between said outer end of said coil and a coil axis is a whole number multiple of half of a grid line width having a permissible deviation of one eighth of the grid line width of a grid network of the gravomagnetic field, wherein the grid line width is in the range of 10 to 100 cm; and an insulating panel including an upper side and a bottom side isolated from each other, said upper side includes a plurality of said coil, and said bottom side including a plurality of counter-wound coils, at least one of said coil being applied as a conductor track;

wherein inner ends of said counter-wound coils do not extend to said coil axis to provide a central conductor track-free region.

2. The device according to claim 1, wherein said largest coil radius (R1) is a whole number multiple of half of the grid line width with the permissible deviation of one eighth of the grid line width of a Hartmann grid.

3. The device according to claim 1, wherein said largest coil radius (R1) is a whole number multiple of half of the grid line width with the permissible deviation of one eighth of the grid line width of a Curry grid.

4. The device according to claim 1, wherein a spacing between windings of said coil and inwards of said coil axis is smaller by 40% to 60% after each full rotation than a previous spacing.

5. The device according to claim 1, wherein said insulating panel defines a recess in said conductor track-free region.

6. The device according to claim 1, wherein said conductor track has a width which corresponds to 0.007 to 0.018 times or 0.015 times said largest coil radius (R1).

7. The device according to claim 1, wherein said conductor track-free region has a diameter selected from the group consisting of at least 3 mm, at least 5 mm, and at least 8 mm.

8. The device according to claim 1, wherein said coil and said counter-wound coil of both said first and second sides of said insulating panel are short-circuited at said center.

9. The device according to claim 8 further comprising at least one further coil, which is electrically conductively connected to said coil and said counter-wound coil by way of a connecting conductor, said further coil extending to said coil axis and is retained in spaced-apart relationship above said insulating panel.

10. The device according to claim 9, wherein said further coil is a spiral coil or cylindrical coil, and wherein said coil, said counter-wound coil and said further coil have the same largest coil radius.

11. The device according to claim 9, wherein a diameter of said conductor track-free region is 2 to 4 times, 2.5 to 3.5 times or 3 times a thickness of said connecting conductor.

12. The device according to claim 9, wherein a spacing between said further coil and said insulating panel is an odd whole number multiple ±10% of half the radius of said largest coil radius (R1).

13. The device according to claim 9, wherein a thickness of said connecting conductor corresponds to 0.01 to 0.05 times or 0.04 times said largest coil radius.

14. The device according to claim 9 further comprising a pair of brackets having a configuration capable of spacing apart said coil and said counter-wound coil with said further coil, said brackets support said coil, said counter-wound coil and said further coil within said housing.

15. The device according to claim 1 further comprising a second insulation panel arranged in spaced-apart relationship above said insulating panel, said second insulating panel having a configuration capable of polarizing energy of the gravomagnetic field absorbed by said insulating panel which receives the gravomagnetic field.

16. The device according to claim 15, wherein said second insulating panel includes an upper side and a bottom side isolated from each other, said upper side of said second panel includes an additional set of a plurality of said coil, and said bottom side includes an additional set of said counter-wound coils, wherein said additional set of said plurality of coil of said second panel are electrically connected by way of a connecting conductor to said plurality of said coil on said upper side of said insulating panel.

* * * * *